US006660983B2

(12) United States Patent
Monforton et al.

(10) Patent No.: US 6,660,983 B2
(45) Date of Patent: Dec. 9, 2003

(54) EASILY EXPANDABLE, NONTRAPPING, FLEXIBLE PAPER, MICROWAVE PACKAGE

(75) Inventors: Randal J. Monforton, Eden Prairie, MN (US); Ronald W. Hegner, Maple Plain, MN (US); Melissa L. Jacobs, Fort Wayne, IN (US); Michael R. Perry, Plymouth, MN (US)

(73) Assignee: General Mills, Inc., Minneapolis, MN (US)

( * ) Notice: Subject to any disclaimer, the term of this patent is extended or adjusted under 35 U.S.C. 154(b) by 127 days.

(21) Appl. No.: 09/943,637

(22) Filed: Aug. 31, 2001

(65) Prior Publication Data

US 2003/0044491 A1 Mar. 6, 2003

(51) Int. Cl.[7] ..... H05B 6/80; B65D 30/10

(52) U.S. Cl. ..... 219/727; 219/735; 219/730; 426/118; 426/234; 99/DIG. 14; 383/200

(58) Field of Search ..... 219/727, 735, 219/730, 732, 734; 426/115, 118, 123, 234, 107, 111, 122, 241, 243; 99/DIG. 14; 383/200, 208, 209, 210, 211

(56) References Cited

U.S. PATENT DOCUMENTS

| | | | |
|---|---|---|---|
| 2,673,805 A | 3/1954 | Colman | |
| 3,052,554 A | 9/1962 | Colman et al. | |

(List continued on next page.)

FOREIGN PATENT DOCUMENTS

| | | | |
|---|---|---|---|
| EP | 0 205 304 A2 | 12/1986 | |
| EP | 0 294 087 A2 | 12/1988 | |
| GB | 776382 | 6/1957 | |
| GB | 2 096 576 A | 10/1982 | |
| JP | 03275474 | 6/1991 | |
| JP | 4-18273 | * 1/1992 | ..... 219/735 |
| JP | 10-230978 | * 9/1998 | |
| WO | WO 91/09656 | 7/1991 | |
| WO | WO 93/19566 | 9/1993 | |
| WO | WO 99/20542 | 4/1999 | |
| WO | WO 99/52790 | 10/1999 | |
| WO | WO 01/05678 | * 1/2001 | |

*Primary Examiner*—Philip H. Leung
(74) *Attorney, Agent, or Firm*—Douglas J. Taylor; John A. O'Toole; Alan D. Kamrath

(57) ABSTRACT

A flexible paper microwave package in the form of an easily expandable, nontrapping bag (18) is disclosed including a bottom wall (20) and a top wall (22) interconnected together adjacent their circular outer peripheries **(20*a*, 22*a*) by first and second interconnection portions (26*a*, 26*b*). In one preferred form, the top wall (22) is formed from a first portion (22*d*) having a generally oval shaped access opening closed by a generally oval shaped closure portion (22*e*) interconnected by a wet adhesive seal (40) to the first portion (22*d*). In a preferred form, the wet adhesive seal (40) is formed by a plurality of spaced, parallel bands (400, 401, 402) defining a plurality of spaced, parallel spaces therebetween for resisting any leakage from the interior of the bag (18) through the seal (40). The bottom and top walls (20, 22) expand into an opposing double domed shape as the food product is being popped, puffed, or expanded in the microwave oven. This domed shape of the bottom wall (20) keeps the food product huddled closer together and enhances the bag (18) to rock to maximize gravimetric separation. The bag (18) provides a serving bowl function when the closure seal (40) has been opened providing access to the interior of the bag (18) and specifically to the popped, puffed or expanded food product located therein. An extension (42) integrally extends from the closure portion (22*e*) along the major axis of the generally oval shape. First and second pairs of extensions (54) integrally extend from diametric opposite sides of the bottom and top walls (20, 22) and along the major axis of the generally oval shape. The closure portion (22*e*) includes a peel element (90) formed therein which breaks away during opening. The interconnection portion (26*a*) includes predictable, preferential venting at locations remote from the extensions (42, 54)**.

34 Claims, 3 Drawing Sheets

U.S. PATENT DOCUMENTS 3,235,165 A 2/1966 Jackson
3,389,783 A 6/1968 Bjorkengren
3,835,280 A 9/1974 Gades et al.
3,873,735 A 3/1975 Chalin et al.
3,973,045 A 8/1976 Brandberg et al.
4,141,487 A 2/1979 Faust et al.
4,292,332 A 9/1981 McHam
4,358,466 A 11/1982 Stevenson
4,448,309 A 5/1984 Roccaforte et al.
4,450,180 A 5/1984 Watkins
4,453,665 A 6/1984 Roccaforte et al.
4,491,224 A 1/1985 Horvath
4,548,826 A 10/1985 Watkins
4,571,337 A 2/1986 Cage et al.
4,596,713 A 6/1986 Burdette
4,640,838 A 2/1987 Isakson et al.
4,673,601 A 6/1987 Lamping et al.
4,708,249 A 11/1987 Emslander et al.
4,734,288 A 3/1988 Engstrom et al.
4,810,844 A 3/1989 Anderson
4,851,246 A 7/1989 Maxwell et al.
4,874,620 A 10/1989 Mendenhall et al.
4,892,744 A 1/1990 Ylvisaker
4,911,938 A 3/1990 Fisher et al.
4,925,684 A 5/1990 Simon
4,936,464 A * 6/1990 Kim ..... 206/617
4,942,050 A 7/1990 Ylvisaker
4,950,859 A 8/1990 Anderson
4,963,374 A 10/1990 Brandel et al.
4,973,810 A 11/1990 Brauner
5,039,001 A * 8/1991 Kinigakis et al. ..... 426/118
5,120,553 A 6/1992 Kupcikevicius
5,171,950 A 12/1992 Brauner et al.
5,189,272 A 2/1993 McDonald et al.
5,195,829 A 3/1993 Watkins et al.
5,294,764 A 3/1994 Mass
5,302,790 A 4/1994 Turpin
5,460,839 A 10/1995 Archibald
5,473,142 A 12/1995 Mass
5,498,080 A 3/1996 Dalea et al.
5,576,037 A 11/1996 Moore, Jr. et al.
5,622,432 A 4/1997 Zicker
D393,590 S 4/1998 Roney
5,770,839 A 6/1998 Ruebush et al.
5,786,010 A 7/1998 Yannuzzi, Jr.
5,958,482 A 9/1999 Monforton
5,989,608 A * 11/1999 Mizuno ..... 426/113
6,030,652 A 2/2000 Hanus
6,060,095 A 5/2000 Scrimager
6,060,096 A 5/2000 Hanson et al.
6,066,346 A 5/2000 Hunt et al.
6,077,551 A 6/2000 Scrimager
6,231,903 B1 * 5/2001 Ji et al. ..... 219/730
6,306,448 B1 10/2001 Martuch et al.
6,410,065 B1 6/2002 Nottingham et al.

* cited by examiner

EASILY EXPANDABLE, NONTRAPPING, FLEXIBLE PAPER, MICROWAVE PACKAGE

BACKGROUND OF THE INVENTION

The present invention relates generally to packages for use in microwave ovens, pertains particularly to an easily expandable, nontrapping, flexible, microwave package formed of non-extendable material for the popping, puffing or expanding of food products and especially popcorn kernels, and pertains more particularly to a microwave package providing serving bowl, preferential location venting, vent oil retention, and/or easy open features.

To conserve space during shipping and storage, microwave popcorn packages are often folded flat. During popping by use of microwave energy, the popcorn package expands, with the expansion due to the internal pressure of steam produced by the popping of the popcorn kernels and produced by the evaporation of the water content of the flavoring slurry, due to the pressure of the popped kernels themselves, as well as due to other factors. An important feature for maximizing the volume of the popped kernels is the ability of the microwave popcorn package to easily expand. Another important factor for maximizing the volume of the popped kernels is that the number of kernels which are actually popped be maximized by insuring that the unpopped kernels are located together on the susceptor with sufficient dwell time or in other words with sufficient rate of heating to receive sufficient heat energy to result in popping. The shape of the bag plays an important role in the ability of the bag to expand as well as the ability of unpopped kernels to come in contact with each other and the susceptor before and during popping.

One form of conventional popcorn packages is a bag having a rectangular top, a rectangular bottom and pleated sides and with at least one end being sealed together by attaching the top and bottom together such as but not limited to by heat sealing. It is a common problem for unpopped kernels to be propelled in the popping process into folds and crevices in the bag and especially those created by the pleats in the sides adjacent to the end(s) of the bag. Such kernels may tend to be captured in such folds and crevices so that they are unable to travel towards the susceptor and are less likely to be popped during microwave cooking.

Further, conventional rectangular popcorn bags tend to get lodged, trapped or otherwise hung up in the corners of the microwave ovens. This is undesirable for microwave ovens including turntables as the bag will no longer rotate inside of the microwave cavity and through varying electrical field patterns but is locked in position by the corner. However, even for microwave ovens which are not equipped with turntables, the expansion of the bag and/or the vibration of the bag caused by the popping of the popcorn kernels do not result in moving the bag to the center of the microwave cavity when the bag gets lodged, trapped or otherwise hung up in a corner of the microwave cavity. This is undesirable as cooler spots typically exist in the comers of the microwave cavity and as lack of movement of the bag subjects certain points in the bag to see specific electrical field nulls or maximums.

Thus, a need continues to exist for an improved flexible paper popcorn package which is easily expandable by the dynamics involved in popping the kernels, which is less likely to capture unpopped kernels during the expansion of the package while subjected to microwave energy, and which exposes the kernels to the most consistent and uniform distribution of microwave energy in maximizing the number and volume of popped popcorn. In further aspects of the present invention, the popcorn package which is utilized to pop the popcorn kernels has the ability to be utilized as the serving bowl during consumption of the popped kernels. In still other aspects of the present invention, the expanded popcorn package can be easily opened by the consumer with minimal instructions.

Surprisingly, the above need and other objectives can be satisfied by providing, in the preferred form, an expandable microwave package in the form of a bag formed by top and bottom walls of flexible, non-extendable material interconnected together adjacent to their round-like shaped outer peripheries so that the top and bottom walls expand into an opposing double domed shape when the food products are popped, puffed or expanded in the microwave oven.

In a most preferred form, the top wall is fabricated from multiple layers and includes a first annular portion having an access opening and a closure portion of a size greater than the access opening and interconnected to the first portion by a seal, with the access opening, closure portion, and seal being generally oval in shape. In the preferred form, the generally oval shape includes a first, generally semicircular portion of a diameter generally equal to the minor axis, second and third portions extending generally parallel to the major axis and a fourth portion interconnecting the second and third portions and in the most preferred form including fifth and sixth portions extending from the second and third portions towards each other and extending tangentially from an arcuate portion of a diameter substantially less than that of the first portion.

In preferred aspects, the seal of the access opening is of the wet seal adhesive type which does not generally fail during microwave cooking and which is maintained during microwave cooking in a manner that does not detrimentally vent, but allows the removal of the closure portion to provide access to the popped, puffed or expanded food product. In preferred forms, the access seal is formed by a plurality of spaced, parallel bands defining a plurality of spaced, parallel spaces for restricting leakage through the access seal. In most preferred forms, the access seal includes a V-shaped portion for concentrating the initial forces created during opening on the juncture and then moving down the legs from the juncture of the V-shaped portion. In most preferred forms of the present invention, the seal overlays a peel element allowing the closure portion to peel from the annular portion without requiring the failure of the seal.

Also, in most preferred aspects, an extension is formed on the outer periphery of the closure portion and extending in line with the major axis of the generally oval shape for grasping when removing the closure portion.

In other preferred aspects of the present invention, the bag formed by the interconnection of top and bottom walls having round-like shaped outer peripheries is folded about first and second, parallel, fold lines located on opposite sides of and parallel to the major axis of the generally oval shaped closure panel so the seal between the annular and closure portions are not subjected to a hard fold. The bag is then folded about a third fold line extending perpendicularly between the first and second fold lines at which time the food products are introduced through a periphery interconnection portion extending between the first and second fold lines opposite to the third fold line which is then sealed, and then folded about a fourth fold line extending parallel to the third fold line, with the folded bag having a rectangular shape to facilitate secondary packaging such as but not limited to being sealed in a flexible overlap.

In still other preferred aspects, extensions are formed on the outer peripheries of the top and bottom walls outward of the interconnection, with the consumer grasping the extensions for removing the bag from the microwave oven, for carrying the bag, and for holding/opening the bag. In preferred aspects, the extensions of the top and bottom walls are in line with the extension of the closure panel of a multiple layer top wall for ease of removal of the closure panel. For other preferred aspects, the extensions extend on diametrically opposite sides of the bag for providing optimal gripping by two hands when the bag is utilized as a serving bowl.

In other preferred aspects of the present invention, a chamber is defined in the most preferred forms in the periphery adhesive strip into which pressure is released from the interior of the package and from which pressure is released to the outside of the package through a vent opening. In the most preferred form, the vent opening is in the form of a slit cut in the top wall spaced from the periphery, and pressure is not released from the interior of the package to the chamber until a V-shaped seal portion extending into the interior of the package fails when subjected to stress as the result of the food product being subjected to microwave energy. In the most preferred form, the V-shaped seal portions, the chambers, and the vent openings are remotely located from the extensions formed on the outer peripheries of the top and bottom walls.

The present invention will become clearer in light of the following detailed description of illustrative embodiments of this invention described in connection with the drawings.

BRIEF DESCRIPTION OF THE DRAWINGS

The illustrative embodiments may best be described by reference to the accompanying drawings where.

Figure 1:
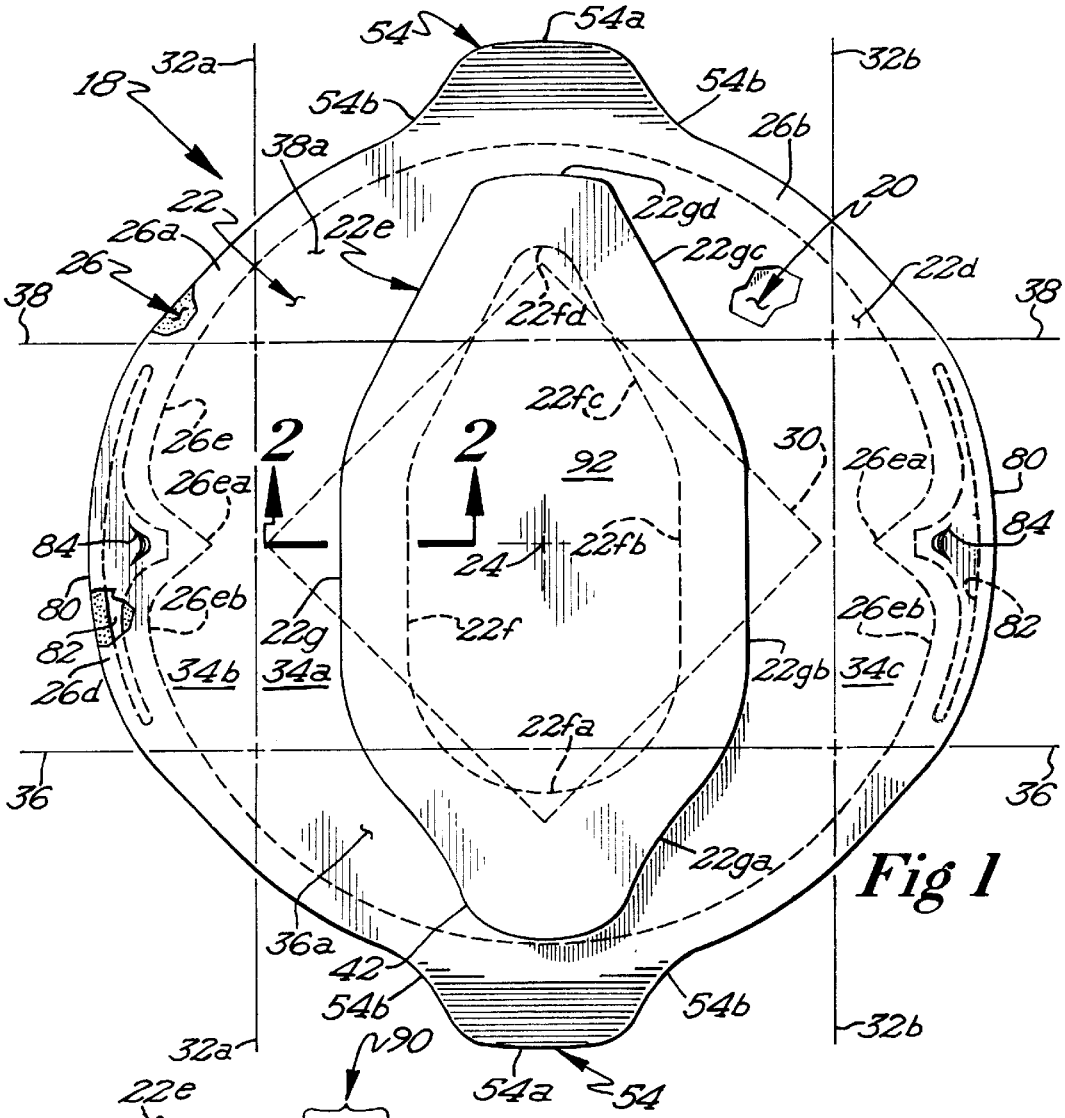
FIG. 1 shows a top plan view of a package fabricated in accordance with the preferred teachings of the present invention in an unfilled, flat condition, with portions shown in phantom and portions broken away.

All figures are drawn for ease of explanation of the basic teachings of the present invention only; the extensions of the Figures with respect to number, position, relationship, and dimensions of the parts to form the preferred embodiments will be explained or will be within the skill of the art after the following teachings of the present invention have been read and understood. Further, the exact dimensions and dimensional proportions to conform to specific force, weight, strength, and similar requirements will likewise be within the skill of the art after the following teachings of the present invention have been read and understood.

Where used in the various figures of the drawings, the same numerals designate the same or similar parts. Furthermore, when the terms "top", "bottom", "first", "second", "side", "end", "inner", "outer", "inside", "outside", and similar terms are used herein, it should be understood that these terms have reference only to the structure shown in the drawings as it would appear to a person viewing the drawings and are utilized only to facilitate describing the preferred embodiments.

DESCRIPTIONS OF THE PREFERRED EMBODIMENTS

A package for use in microwave ovens according to the preferred teachings of the present invention is shown as an expandable, flexible bag in the drawings and generally designated 18. In the most preferred embodiments of the present invention, bag 18 is an improvement of the type shown in U.S. Pat. Nos. 5,958,482 and 6,077,551, U.S. patent application Ser. No. 09/354,545 now U.S. Pat. No. 6,306,448; and in International Publication WO 01/05678. For purpose of explanation of the basic teachings of the present invention, the same numerals designate the same or similar parts. The description of the common numerals and bag 18 may be found herein and in U.S. Pat. Nos. 5,958,482 and 6,077,551, U.S. patent application Ser. No. 09/354,545; and in International Publication WO 01/05678, which are hereby incorporated herein by reference.

It will facilitate the ensuing description to consider bag 18 in the horizontal position when placed in the microwave oven. Therefore, bag 18 includes a bottom wall 20 and a top wall 22 of a shape and size generally corresponding to bottom wall 20. Each wall 20 and 22 is formed by a sheet of flexible but non-extendable material such as papers including but not limited to base coated paper or similar cellulose structures, polymers including but not limited to polyethylene terephthalate, polyester and nylon, or other like microwaveable materials. The material forming walls 20 and 22 can be opaque, translucent, clear, or combinations thereof. Each wall 20 and 22 includes an outer periphery 20*a* and 22*a*, respectively, which is generally equidistant from the center 24 of the shape of walls 20 and 22 and in the most preferred form is generally circular in shape. However, peripheries 20*a* and 22*a* could be in other substantially round or round-like shapes which are arcuate and/or include peripheral edge interconnections which do not have a tendency of getting hung up in the corners of the microwave oven such as symmetrical shapes including ovals, pentagons, hexagons, heptagons, octagons, etc. and such as non-symmetrical shapes such as a generally egg shape.

To define a hollow interior, walls 20 and 22 are interconnected together adjacent to peripheries 20*a* and 22*a* by a seal which maintains the integrity of bag 18 during manufacture, handling, transportation and retailing of bag 18 and its contents and until microwave cooking. In the most preferred form, the interconnection between walls 20 and 22 is sufficient so as to seal adequately the vapor created within the bag 18 during at least the initial heating thereof in the microwave oven as well as to prevent undesired opening during the consumption of the popped, puffed, or expanded food products. In the most preferred form, a suitable annular adhesive strip 26 is added to the inside surface of one or both of walls 20 and 22 to secure and thereby interconnect walls 20 and 22 together adjacent peripheries 20*a* and 22*a* after the application of heat and/or pressure. Additionally, when interconnected by adhesive strip 26, walls 20 and 22 can be positioned so that they are generally planar and continuously abut without bulges or folds in the most preferred form.

Bag 18, according to the preferred teachings of the present invention, can be manufactured in the following manner.

Specifically, walls 20 and 22 are positioned with their inside surfaces abutting together and with peripheries 20*a* and 22*a* aligned. A first, interconnection portion 26*a* of strip 26 is suitably activated to interconnect walls 20 and 22 together aside from a second, interconnection portion 26*b*. While first, interconnection portion 26*a* extends a substantial portion of peripheries 20*a* and 22*a*, second, interconnection portion 26*b* in the preferred form has a radial extent generally equal to one half of the diameter of the shape of peripheries 20*a* and 22*a*.

Figure 2:
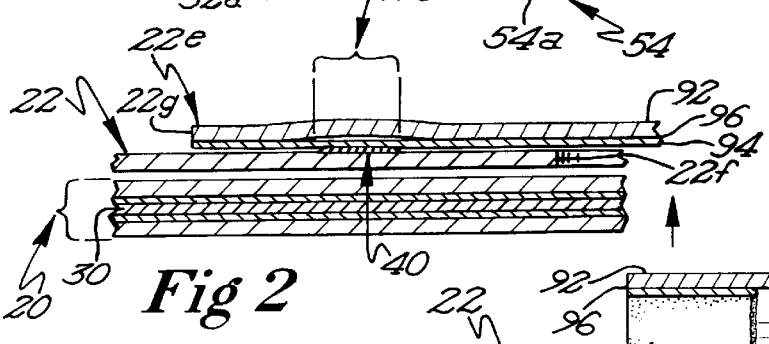
FIG. 2 shows a cross sectional view of the package of FIG. 1 according to section line 2—2 of FIG. 1.
Figure 3:
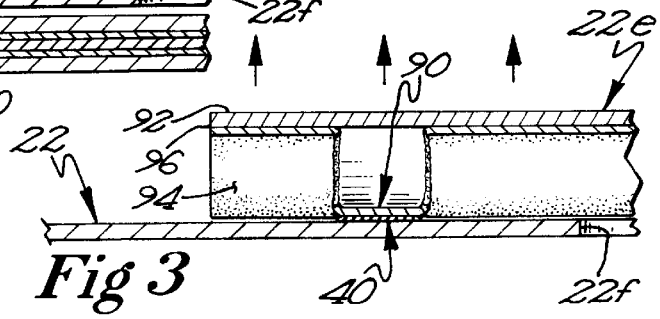
FIG. 3 shows a partial, cross sectional view of the package of FIG. 1 being opened.

In the most preferred form, bag 18 includes a susceptor patch 30 that extends over a portion of bottom wall 20 spaced from periphery 20*a* and in the most preferred form generally centered about center 24. Susceptor patch 30 can be formed in any suitable manner known in the art such as a metalized plastic film adhered to bottom wall 20 or adhered between separate laminates forming bottom wall 20 as shown in FIG. 2, as a paper backed susceptor, or as a coating applied or printed to bottom wall 20. Further, although susceptor patch 30 of the preferred form is positioned within bottom wall 20, susceptor patch 30 can be located outside of bag 18 with bottom wall 20 overlying susceptor patch 30 or can be located inside of bag 18 with susceptor patch 30 overlying bottom wall 20. Further, placement of susceptor patch 30 can occur at the material converter or on the manufacturing lines.

In the preferred form shown, top wall 22 is fabricated from multiple layers of material. In a preferred form as shown, top wall 22 is formed from first and second wall portions 22*d* and 22*e* which are interconnected by a seal 40. In the preferred form shown, portion 22*d* is generally annular in shape including outer periphery 22*a* and an inner periphery 22*f* defining an access opening which is generally oval in the most preferred form, with periphery 22*a* being of a size larger than periphery 22*f*. The size of the access opening should be sufficient to extend fingers or a hand into the interior of bag 18 and grasp popped, puffed or expanded food product therefrom. In the most preferred form, inner periphery 22*f* includes a generally semicircular edge 22*fa* of a diameter generally equal to the minor axis of the generally oval shape. Inner periphery 22*f* further includes first and second linear edges 22*fb* extending generally parallel to each other and the major axis of the generally oval shape and spaced generally equal to the diameter of edge 22*fa*, with edges 22*fb* extending generally tangentially from the free ends of edge 22*fa*. First and second linear edges 22*fc* extend at an obtuse angle in the order of 130° from the ends of edges 22*fb* towards each other. Inner periphery 22*f* further includes an arcuate edge 22*fd* of a diameter substantially less than the diameter of edge 22*fa*, with edge 22*fd* extending generally greater than 90° but less than 180° with edges 22*fc* extending generally tangentially from the free ends of edge 22*fd*. It can be appreciated that edges 22*fc* and 22*fd* create a portion interconnecting edges 22*fb* to thereby define the generally oval shape.

Portion 22*e* acts as a closure portion and is generally oval in shape and includes an outer periphery 22*g* which is of a generally oval shape generally corresponding to periphery 22*f* but of a size slightly greater than periphery 22*f*. In particular, outer periphery 22*g* includes edges 22*ga*, 22*gb*, 22*gc* and 22*gd* generally corresponding to, parallel but spaced outwardly from edge 22*fa*, 22*fb*, 22*fc*, and 22*fd*, respectfully. In the most preferred form, outer periphery 22*g* includes an extension 42 beyond the otherwise generally oval shape and in the direction of and in line with the major axis of the generally oval shape, with extension 42 integrally extending from and being contiguous with edge 22*ga* of periphery 22*g*. Extension 42 is of a size located within outer periphery 22*a* of top wall 22 in the preferred form shown.

Figure 7:
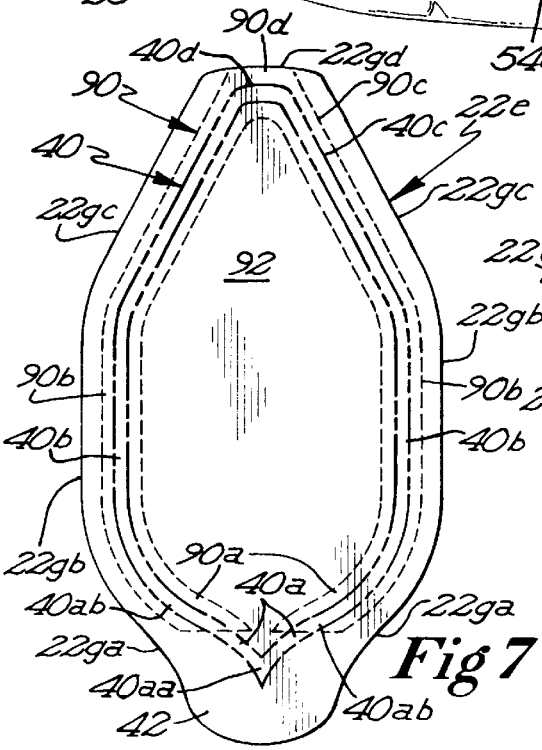
FIGS. 7 and 8 show partial, bottom, plan views of a closure portion of alternate embodiments of a package in accordance with the preferred teachings of the present invention.
Figure 8:
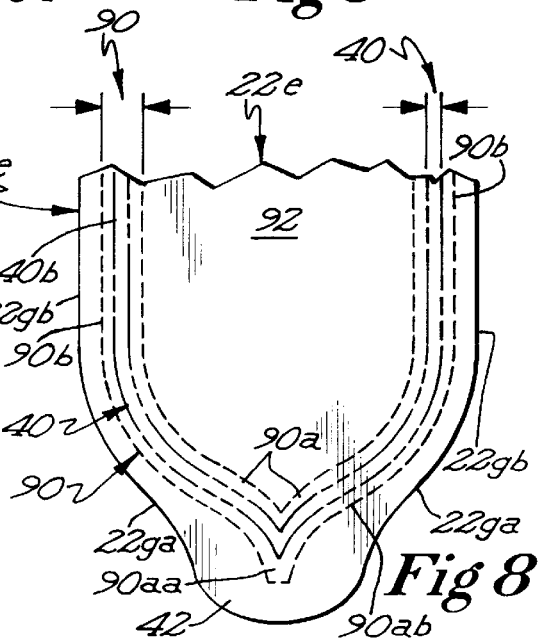
Figure 6:
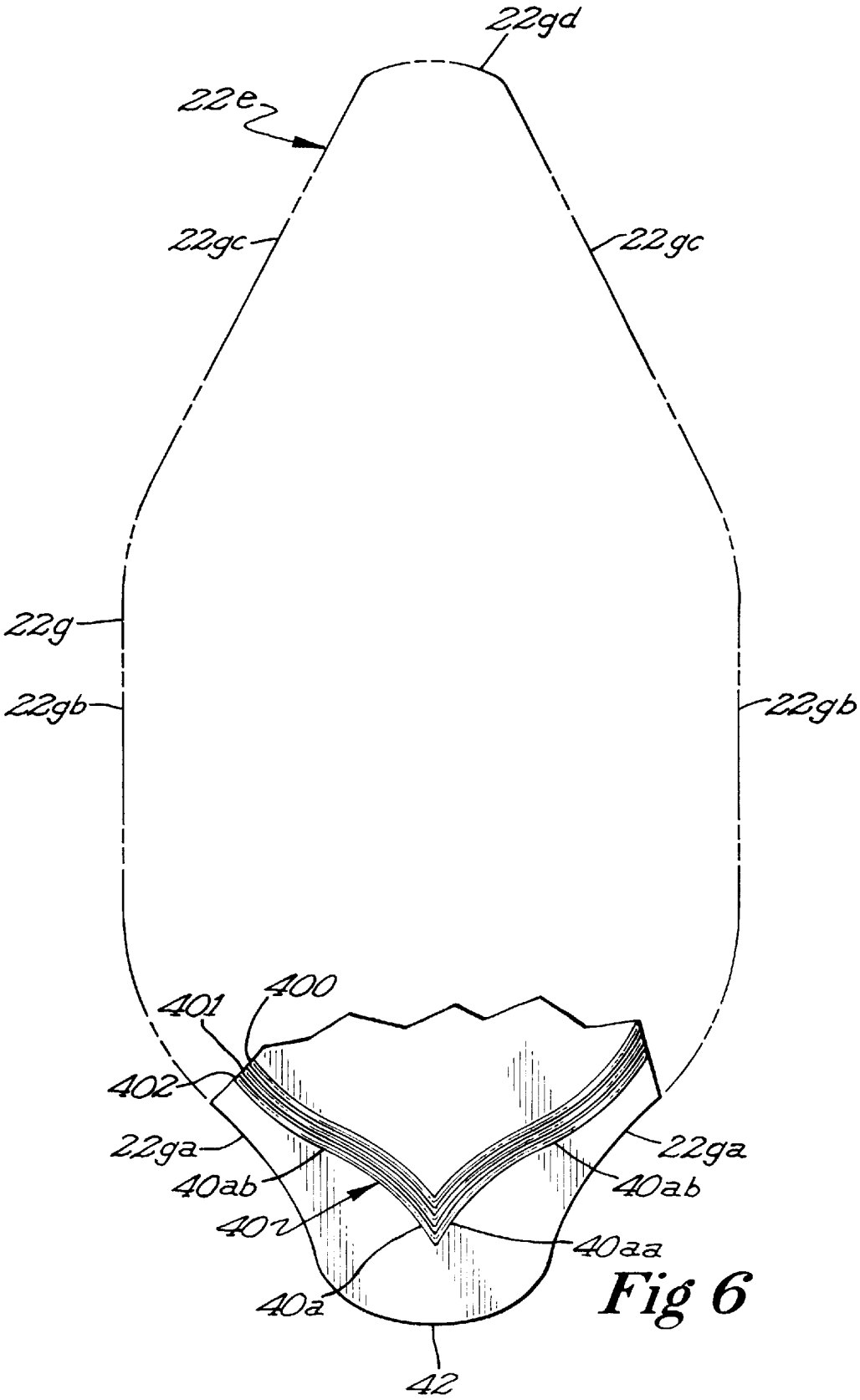
FIG. 6 shows a bottom, plan view of the closure portion of the package of FIG. 1 according to view line 6—6 of FIG. 5.

Seal 40 extends around, and in the most preferred form completely around, the access opening of wall portion 22*d* such that wall portion 22*e* closes the access opening. Specifically, in the preferred form, seal 40 is annular in shape generally corresponding to but spaced inwardly from inner periphery 22*f* of portion 22*d* and generally corresponding to but spaced inwardly from outer periphery 22*g* of portion 22*e*. Thus, seal 40 is generally oval in shape and in the most preferred form is dictated by the shapes of its peripheries 22*f* and 22*g* of portions 22*d* and 22*e*. In particular, seal 40 includes portions 40*a*, 40*b*, 40*c*, and 40*d* generally corresponding to and parallel to but spaced from edges 22*fa* and 22*ga*, 22*fb* and 22*gb*, 22*fc* and 22*gc*, and 22*fd* and 22*gd*, respectfully. In the most preferred form, portion 40*a* of seal 40 includes a first, V-shaped seal portion 40*aa* having first and second linear portions or legs interconnected at first ends at a juncture with the first and second legs extending relative to each other from the juncture at a nonparallel angle in the range of very close to 0° to typically not greater than 60° and most preferably in this arrangement in the order of 45°. The juncture could be in the form of a point defined by the intersection of two lines as diagrammatically shown in FIGS. 6–8, by an arcuate portion extending between two lines, by a flat portion extending between two lines, or by a combination thereof. A bisector of the nonparallel angle is in line with the major axis of the generally oval shape. Extension 42 extends along the bisector of the non-parallel angle of seal portion 40*aa* and in a direction opposite to the direction that the first and second legs extend from the juncture of seal portion 40*aa*. First and second legs of seal portion 40*aa* extend generally into first and second arcuate portions 40*ab* which terminate in portions 40*b*.

In the most preferred form, portion 22*e* includes peel element 90 incorporated therein. Peel element 90 allows wall portion 26*e* to peel from wall portion 26*d* without requiring the failure of seal 40, with seal 40 extending over and overlaying peel element 90. In this regard, seal 40 can extend for its entire length over peel element 90, for its partial length over peel element 90, or for selected portions of its length over peel element 90. Particularly, in the preferred form, portion 22*e* is formed from two or more laminates 92 and 94 which are adhered together by an adhesive 96 to form a single layer. According to the preferred teachings of the present invention, adhesive 96 is applied in a pattern and specifically such that adhesive 96 is not applied between laminates 92 and 94 in the area or pattern where laminates 92 and 94 are not adhered together and define peel element 90. Peel element 90 has a size and shape for receiving seal 40, with the width of peel element 90 being considerably larger in the preferred form to allow for manufacturing tolerances in the placement of seal 40 relative to portion 22*e*. Particularly, in one preferred form, peel element 90 is of an annular configuration and includes portions 90*a* and 90*aa* and 90*ab*, 90*b*, 90*c*, and 90*d* corresponding to and receiving seal portions 40*a* and 40*aa* and 40*ab*, 40*b*, 40*c* and 40*d*, respectively. In an alternate form, peel element 90 is not annular and includes portions 90*ab*, 90*b*, 90*c*, and 90*d* corresponding to and receiving seal portions 40*ab*, 40*b*, 40*c*, and 40*d*, respectfully, but which does not contain a portion corresponding to seal portions 40*aa* such that only selected portions of seal 40 extend over peel element 90. It of course can be appreciated that peel element 90 can be arranged in other patterns than shown. In the preferred form, laminates 92 and 94 are not required to be equal thickness or strength, with laminate 94 which overlays seal 40 being thinner or less basis weight than laminate 92. As an example, laminate 94 could have a basis weight of 18 to 25 pounds (6.7 to 9.3 kg) per ream whereas laminate 92 could have a basis weight of 18 to 50 pounds (6.7 to 18.6 kg) per ream.

Extension 42 in the most preferred form is not adhered and specifically in the form shown is not adhered to portion 22*d* or any other portions of top wall 22 or bag 18 except possibly for and during fabrication of the package. Additionally, in the preferred form, seal 40 is a cold seal and in the most preferred form is a cohesive formed from wet seal adhesives which are conventionally utilized to form the bottom of conventional rectangular popcorn bags and particularly for seals not intended or desired to vent during cooking and/or to be opened by the consumer. If applied properly, the wet seal adhesive creating seal 40 will penetrate into the fiber substrates of wall portions 22*d* and 22*e* and does not just sit on the surface of the paper laminates such that a very strong bond exists between wall portions 22*d* and 22*e* having strong shear (lap) strength and strong tensile (peel) strength.

Bag 18, according to the preferred teachings of the present invention, can be manufactured in the following manner. Specifically, portion 22*e* is positioned to overlie portion 22*d*. Seal 40 is suitably activated such as by pressure in the preferred form to interconnect portions 22*d* and 22*e* to form wall 22. In the preferred form, seal 40 is applied to wall portions 22*d* and/or 22*e* by printing processes, with the adhesive not necessarily being applied evenly. Specifically, adhesive can often corrugate on wall portions 22*d* and/or 22*e*, and especially when seal 40 is formed by pressure without the application of heat, seal 40 will include minute channels which will allow small leaks allowing minimal venting of trapped steam therethrough. However, small leaks often result in larger leaks and thus failure of the seal 40 during microwave cooking. In the preferred form, seal 40 is formed by a plurality of spaced, parallel bands defining a plurality of spaced, parallel spaces therebetween, with first, second and third bands 400, 401, and 402 of the most preferred form being shown in FIG. 6. It should be appreciated that bands 400–402 are also applied by printing processes and thus include application imperfections which can allow small leaks. However, for a typical seal 40, pressure leaking through an application imperfection in band 400 will have to travel in the space between bands 400 and 401 to an application imperfection in band 401 which is typically at a different circumferential location than the application imperfection in band 400. After leaking through the application imperfection in band 401, the pressure will have to travel in the space between bands 401 and 402 to an application imperfection in band 402 which is typically at a different circumferential location than the application imperfections in bands 400 and 401. Additionally, the spaces between bands 400 and 401 and bands 401 and 402 can collect steam, gas and liquefied and/or vaporized grease product passing through bands 401 and/or 400 to resist leakage through seal 40, even when application imperfections are at the same or adjacent circumferential locations in bands 400–402. Due to the tortuous path of the pressure through seal 40 created by bands 400–402 and/or the space collection, small leaks through seal 40 do not detrimentally vent bag 18 and/or result in failure of seal 40. Prior to the present invention, seal 40 of a single strip was applied in a width in an attempt such that application imperfections did not extend across the total width of the strip. Bands 400, 401, and 402 have a combined width generally equal to or less than a single strip forming seal 40. However, bands 400–402 provide a significant reduction in the venting and/or failure through seal 40 according to the teachings of the present invention.

In the fabrication of bag 18, wall 22 is positioned relative to wall 20 such that second, interconnection portion 26*b* is in the direction of the major axis of the generally oval shape of wall portion 22*e* and in the most preferred form with extension 42 being radially on the opposite side of wall portion 22*e* than interconnection portion 26*b*. Additionally, it should be appreciated that portion 22*d* can be interconnected to portion 22*e* before, at the same time, or after the interconnection is made between walls 20 and 22 by adhesive strip 26 or portions 26*a* or 26*b* of strip 26.

In the most preferred form, peripheries 20*a* and 22*a* of walls 20 and 22 include peripheral extensions 54 which extend beyond and on diametric opposite sides of the round-like shape of peripheries 20*a* and 22*a*, with one of the pairs of extensions 54 extending radially outward of extension 42 of wall portion 22*e*. Extensions 54 according to the preferred teaching of the present invention are configured to maximize the visibility and intended use thereof for gripping bag 18 and to minimize any detraction from the intended operation of bag 18. In particular, extensions 54 include a main area 54*a* of a generally arcuate configuration and specifically include an inner edge corresponding to, contiguous with, and integrally formed with peripheries 20*a* and 22*a* and an outer edge parallel to but spaced radially outward of the inner edge of area 54*a*. In the preferred form, the spacing between the inner and outer edges or the depth of area 54*a* is within the range of 5 to 15 percent of the diameter of the round-like shape of walls 20 and 22 and specifically in a manner which does not determinately detract from the round-like shape of peripheries 20*a* and 22*a* but which provides the desired visual indication to the consumer. Extensions 54 further include first and second transition areas 54*b* including an inner edge corresponding to, contiguous with, and integrally formed with peripheries 20*a* and 22*a* and an outer edge which provides a smooth transition from the outer edge of main area 54*a* and peripheries 20*a* and 22*a*. In particular, the outer edges of the interconnection of main area 54*a* and areas 54*b* are arcuate in configuration, preferably having a radius in the order of 12.5% of the diameter of the round-like shape and in the order of 80% of the depth of area 54*a*. Outer edges of transition areas 54*b* are generally arcuate of a radius in the order of 40% of the diameter of the round-like shape and generally equal to the length of extension 54 at peripheries 20*a* and 22*a* and which extend generally tangentially to peripheries 20*a* and 22*a* and which extend generally tangentially to the interconnection between area 54*a* and 54*b*. The use of tangent and large radius transitions provides a smooth transition between extensions 54 and peripheries 20*a* and 22*a* and minimizes the detraction from the round-like shape of peripheries 20*a* and 22*a* while maximizing the total visibility area.

In the most preferred form, extensions 54 of top and bottom walls 20 and 22 are completely adhered together such that the total adhered area is equal to the combined width of adhesive strip 26 and extensions 54. Likewise, extensions 54 of both top and bottom walls 20 and 22 are free of slits, cuts, or openings, which could allow escape of pressure and thereby provide a reduced length path from the interior of bag 18 to the exterior. Therefor, there is little possibility of seal failure and venting from the interior of bag 18 to the outer edge of extensions 54 as the radial distance to seal failure will be less at other locations where adhesive strip 26 has a lesser width, and in the most preferred form, at preferential venting locations which will be described further hereinafter. The preferred configuration of extensions 54 is also advantageous in the inflation of bag 18 as will be explained further hereinafter.

Bag 18 according to the preferred teachings of the present invention can be filled in the following manner. Specifically, after walls 20 and 22 have been interconnected along portion 26*a*, the partially formed bag 18 can be folded along parallel fold lines 32*a* and 32*b* extending from first and second points on opposite sides of and generally coextensive with the ends of portion 26*b*. Fold lines 32*a* and 32*b* are radially spaced generally equal to one half of the diameter of the shape of peripheries 20*a* and 22*a* and in the most preferred form slightly larger than the maximum width in a direction of the minor axis of the generally oval shape of wall portion 22*e*. In the preferred form, fold lines 32*a* and 32*b* are located on opposite sides of the diameter of the shape of peripheries 20*a* and 22*a* and of the major axis of the generally oval shape of wall portion 22*e* and equidistant therefrom and in the most preferred form on opposite sides of and outside of wall portion 22*e*. Thus, bag 18 is divided into a central portion 34*a* and first and second wings 34*b* and 34*c* which are folded to overlay central portion 34*a*. Wings 34*b* and 34*c* have a radial width generally equal to one fourth of the diameter of the shape of peripheries 20*a* and 22*a* and generally equal to one half of the radial width of central portion 34*a*. Thus, wings 34*b* and 34*c* do not overlay each other when folded to overlay central portion 34*a*. Bag 18 as folded at this point includes first and second, parallel, straight side edges defined by fold lines 32*a* and 32*b* and upper and lower edges which are generally convex defined by peripheries 20*a* and 22*a* intermediate fold lines 32*a* and 32*b*.

The partially formed bag 18 can then be folded about a third fold line 36 extending generally perpendicularly between the first and second straight side edges defined by fold lines 32*a* and 32*b* and located about one third of the diameter of the shape of peripheries 20*a* and 22*a* from the lower edge. Thus, bag 18 includes a wing 36*a* which includes the lower parts of portion 34*a* and wings 34*b* and 34*c* and which is folded to overlay wings 34*b* and 34*c*, with portion 26*b* being opposite to wing 36*a*. Bag 18 as folded at this point includes first and second, parallel, straight side edges defined by fold lines 32*a* and 32*b*, a straight lower edge defined by fold line 36 extending generally perpendicular to the side edges, and an upper edge which is generally convex defined by peripheries 20*a* and 22*a* intermediate fold lines 32*a* and 32*b* and including portion 26*b*.

While in a folded condition and held with walls 20 and 22 being vertical with the upper edge located vertically above the lower edge, peripheries 20*a* and 22*a* in the upper edge are separated and a food product such as a charge of popcorn kernels, fat or oil, salt, flavorings, or the like are introduced into the interior of bag 18. It should be appreciated that due to the folded condition of bag 18, the charge is generally prevented from passing beyond fold lines 32*a*, 32*b* and 36 and into wings 34*b*, 34*c*, and 36*a* but is retained adjacent center 24 of bag 18.

After the food product has been introduced, portion 26*b* can be suitably activated to interconnect walls 20 and 22 together. Thus, walls 20 and 22 are interconnected together around the entire length of peripheries 20*a* and 22*a*. Additionally, strip 26 and seal 40 close bag 18 so that the food product in the hollow interior of bag 18 is completely sealed from the environment.

After portion 26*b* is sealed, bag 18 can again be folded about a fourth fold line 38 extending generally perpendicularly between the first and second straight side edges defined by fold lines 32*a* and 32*b* and parallel to fold line 36 and located about one third of the diameter of the shape of peripheries 20*a* and 22*a* from the upper edge. Fold line 38 is located adjacent to peripheries 20*a* and 22*a* of wing 36*a* and is located above the food product in the hollow interior of bag 18. Thus, bag 18 includes a wing 38*a* which includes the upper parts of portion 34*a* and wings 34*b* and 34*c* and which is folded to overlay wing 36*a*. It should be appreciated that due to the folded condition of bag 18, the food product is also generally prevented from passing beyond fold line 38 and into wing 38*a* but is retained adjacent center 24 of bag 18. Bag 18 as folded at this point is generally rectangular shaped of a size and shape of conventional folded, paper popcorn bags and includes first and second parallel side edges defined by fold lines 32*a* and 32*b*, and parallel lower and upper edges defined by fold lines 36 and 38, respectively. In the most preferred form, the folded, charged bag 18 is sealed into a flexible overwrap for packaging and storage. Conventionally, such overwrap is formed by clear, opaque, or translucent plastic but could be formed by metalized film, sputtered glass/ceramic or other barrier constructions. It of course should be appreciated that typically such overwrap is removed by the consumer just prior to microwave cooking.

Figure 4:
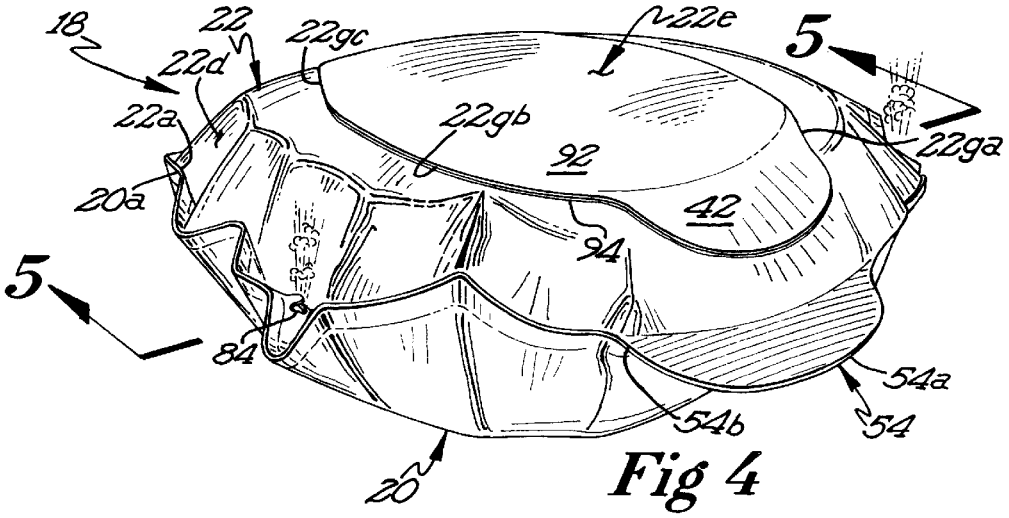
FIG. 4 shows a perspective view of the package of FIG. 1 in an expanded condition.
Figure 5:
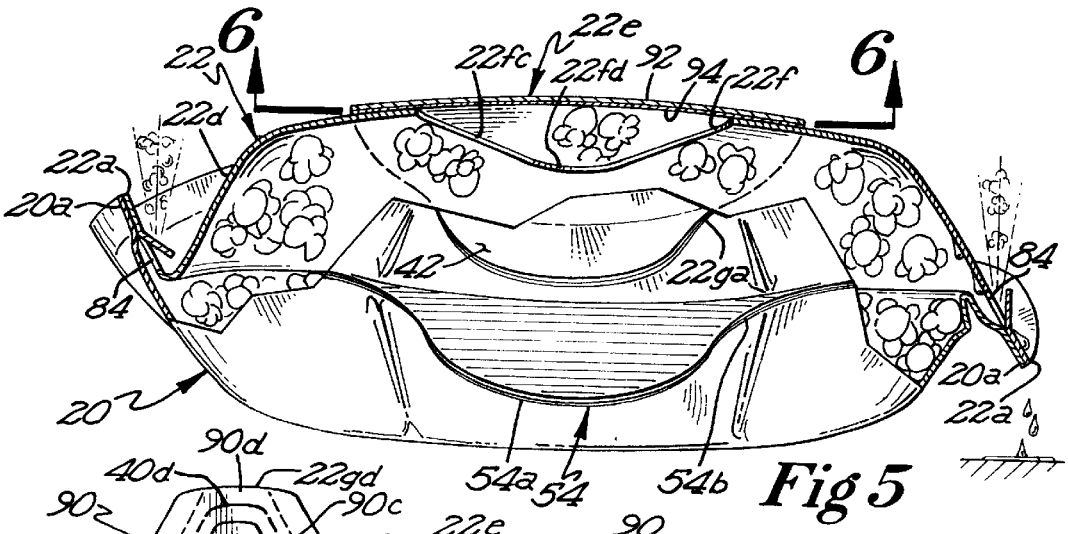
FIG. 5 shows a perspective, partially cross sectional view of the package of FIG. 1 in an expanded condition according to section line 5—5 of FIG. 4, with portions broken away.

For the sake of completeness, it will be assumed for the most preferred form that the contents or charge of bag 18 are popcorn kernels, any suitable grain such as rice, maze, barley, sorghum, or the like or other grain, starch or protein based pellets or materials such as half products and pork rinds for being popped, puffed, or expanded when in the microwave oven. Particularly, as with current bags, bag 18 is placed in a microwave oven with bottom wall 20 resting upon the bottom surface of the oven cavity and preferably with bag 18 being partially or completely unfolded by the consumer. When subjected to microwave energy, susceptor patch 30 converts microwave energy into heat, with the heat and remaining microwave energy causing, in the case of popcorn kernels, the popping of the kernels and the generation of water vapor/steam. The water vapor and heated vapor pressure air cause wings 38*a*, 36*a*, 34*b* and 34*c* to unfold or to continue to unfold about fold lines 38, 36, 32*a* and 32*b*, respectively, so that walls 20 and 22 have a continuous shape. Each wall 20 and 22 expand into a bowl, hemispheric or parabolic curve shape from their peripheries 20*a* and 22*a* with the inside surfaces of bottom and top walls 20 and 22 being spaced, expanding bag 18 and increasing the interior volume inside of bag 18 for the popped kernels. It can then be appreciated that due to its flexible nature, bag 18 will expand to an opposing, double dome shape. However, due to the non-extendable nature of the material forming walls 20 and 22, the interconnection between walls 20 and 22 adjacent to peripheries 20*a* and 22*a* will tend to gather and pucker as best seen in FIG. 4 as walls 20 and 22 change their shape from being generally planar to being dome shaped. When bag 18 is formed of paper conventionally utilized for popcorn packages without further processing, the size, shape and direction of such puckers will generally not be uniform around peripheries 20*a* and 22*a* and will tend to vary between different bags 18. Additionally, according to the preferred teachings of the present invention, adhesive strip 26 interconnecting walls 20 and 22 creates an annular lip or flange extending outwardly of the hollow interior of bag 18, with the annular lip or flange tending to flip either up or down and specifically which is not horizontally maintained. The preferred construction of extensions 54 is believed to be advantageous. In particular, extensions 54 according to the preferred form tend to have a final inflated position which extends radially outward and which does not flip up or down and such that the outer edge is not located adjacent to walls 20 and 22. If flipping up or down, extensions 54 would be less visible and/or would be harder to grip such that there would be less indication that extensions 54 are intended to be gripped and a greater likelihood that the consumer would attempt to grip bag 18 at other locations than at extensions 54. Extensions 54 according to the teachings of the present invention include several characteristics that enhance the desired performance of bag 18. Specifically, the total circumferential length of extensions 54 is less than the spacing between fold lines 32*a* and 32*b* and that extensions 54 do not have any creases or the like that could reduce integrity and which may adversely affect the inflated position. Similarly, in addition to reducing the possibility of seal failure and venting through extensions 54, the complete adhesion of extensions 54 of top and bottom walls 20 and 22 and the absence of slits, cuts or openings in extensions 54 add rigidity to insure that extensions 54 extend in a single direction over its entire circumferential length, which in the preferred form is radially outward. Additionally, transition areas 54*b* play an important role in the final position in that if the outer edges had a small radius, such as approaching a radial orientation, extensions 54 could easily flip up or down in the final inflation position, resulting in less visibility and being harder to grip. On the other hand, an excessive radius would require extensions 54 to deflect for package expansion and inflation, with such deflection being unpredictable and thus undesirable.

Bag 18 according to the preferred teachings of the present invention is advantageous over prior microwave popcorn bags. Particularly, when first placed in the microwave oven, the pleats of the sides of conventional popcorn packages extend at least partially over the charge of popcorn kernels to be popped. Thus, the initial microwave energy has to penetrate several layers of material which forms the bag. As the material is not completely transparent to microwave energy, part of the microwave energy is absorbed by the material which then is generally not available to the charge of popcorn kernels. However, only a single layer of material forming walls 20 and 22 of bag 18 extends over the charge of popcorn kernels generally from the start of microwave cooking. Thus, it is not necessary for the initial microwave energy to penetrate several layers of material before reaching the charge and therefore the microwave energy is generally available quicker and in greater amounts to the charge.

Further, the bowl or parabolic curve shape of the inflated bag 18 keeps the unpopped kernels huddled closer together even in more than a single layer at the bottom of the shaped wall 20 and in closer contact with susceptor patch 30 in the preferred form. This close nesting or clustering of the unpopped kernels is a very efficient and attractive load for incoming microwaves. Specifically, the cluster load radiates less heat, and temperature increases at a quicker rate. The cluster load has a higher loss tangent (more lossy) than a dispersed load.

Further, as the bowl or parabolic curve shape has a relatively low surface area to volume relationship similar to that of a sphere, walls 20 and 22 include less material which competes for microwave energy with the kernels.

Additionally, when the kernels pop, the popping kernels may spray unpopped kernels from the nesting. However, bag 18 according to the teachings of the present invention allows the unpopped kernels to settle to the bottom of the shaped wall 20 much like a covered Japanese Wok pan does. Further, the expansion of bag 18 according to the teachings of the present invention generally does not create folds or crevices which capture unpopped kernels and prevent their movement towards the cluster of any other unpopped kernels and/or susceptor patch 30.

Furthermore, the force of the popping kernels hitting against walls 20 and 22 jostles or vibrates bag 18 which enables the unpopped kernels to fall through the popped kernels and reengage wall 20 and to slide on wall 20 to the bottom thereof. Specifically, the vibration of bag 18 creates agitation of the popped and unpopped kernels in bag 18 resulting in gravimetric separation of the unpopped kernels to the bottom of the popped kernels due to their greater density. In this regard, the bowl or parabolic curve shape of bottom wall 20 enhances the ability of bag 18 to rock in any direction from the force of the popping kernels hitting against walls 20 and 22 to maximize the gravimetric separation of the unpopped kernels to the bottom of the popped kernels.

Still further, the bowl or parabolic curve shape of inflated bag 18 greatly improves popping performance in the diverse microwave ovens available to consumers. As much as a 40% improvement in popping performance was experienced with bag 18 according to the preferred teachings of the present invention compared to paper popcorn bags of conventional shapes under variations experienced in normal use. These variations include but are not limited to microwave ovens of differing wattage, volume, and/or efficiency, fluctuations in electric current, different magnetrons of the same or different manufacture, different wave guides, and the like.

If susceptor patch 30 is provided as in the preferred form, there is no need to include susceptor patch 30 at locations where unpopped kernels are not. Thus, susceptor patch 30 is located only at the bottom of the shaped wall 20 and can be of a minimized size due to the bowl or parabolic curve shape of wall 20. In this regard, and especially due to the bowl or parabolic curve shape of wall 20, susceptor patch 30 may be shaped to minimize material utilized such as being circular in shape or being in non-continuous areas. In the most preferred form, patch 30 is generally located within fold lines 32*a*, 32*b*, 36, and 38.

Also, the round-like shapes of peripheries 20*a* and 22*a* of walls 20 and 22 and thus of bag 18 distribute the popped kernels into a wider distribution field. Being spread in the microwave oven cavity, the popped kernels become less attractive and are fairly transparent to the microwave energy. In addition to the less dense load configuration, the popped kernels are able to dissipate the heat better and therefore not allowing the popped kernels to continue to overcook, carmelize, burn, char, or dry out any further. This results in bag 18 that may be less prone to scorching the popped product.

Further, the round-like shapes of peripheries 20*a* and 22*a* of walls 20 and 22 and thus of bag 18 work very well in all microwave ovens equipped with or without turntables. No matter where the consumer places bag 18 in the microwave oven, bag 18 will always inflate and position itself near the center of the microwave oven. The round-like profile does not allow bag 18 to get lodged, trapped or otherwise hung up in the comers of the microwave ovens where typically cooler spots exist. The round-like shape typically continues to rotate on the turntable ovens. The configuration of extensions 54 and particularly the depth thereof and the smooth transition from peripheries 20*a* and 22*a* provided by transition areas 54*b* generally maintains the round-like shape and in particular does not practically detract from its ability to center and/or rotate. This centered and/or rotating positioning of bag 18 allows bag 18 to move so that it is less likely for any particular point in bag 18 to see specific electrical field nulls or maximums and allows the opportunity for the most consistent and uniform distribution of microwave cooking.

In the most preferred form, adhesive strip 26 partially releases during microwave cooking to vent steam from bag 18 during microwave cooking whereas seal 40 remains secured. Specifically, in the preferred form, adhesive strip 26 includes at least one and preferably two provisions providing predictable, preferential venting of bag 18. Particularly, in the most preferred embodiment, adhesive strip 26 is divided in at least one vent location and in the most preferred form at two locations into first and second portions 26*d* and 26*e*, with portion 26*e* located inwardly of portion 26*d*. In the preferred form, portions 26*d* and 26*e* are located at positions remote from extensions 42 and 54, preferably at the maximum distance from extensions 42 and 54, and in the most preferred form at position 90° from extensions 54 along peripheries 20*a* and 22*a*. In the preferred form, first portion 26*d* is generally arcuate in configuration having inner and outer parallel edges having a spacing which is generally equal to one half of the spacing between strip 26 at locations other than adjacent to extensions 54. In the most preferred form, the arcuate shape of first portion 26*d* has a radius less than walls 20 and 22, with peripheries 20*a* and 22*a* of walls 20 and 22 including peripheral enlargements 80 which extend beyond and on diametric opposite sides of the round-like shape of peripheries 20*a* and 22*a* corresponding to the outer edge of first portions 26*d*.

Second portion 26*e* includes a V-shaped, center, seal portion 26*ea* having first and second legs interconnected at first ends at a juncture with the first and second legs extending relative to each other at a non-parallel angle from the juncture. Specifically, the first and second legs include V-shaped parallel inner and outer edges having a spacing which is generally equal to the spacing of portion 26*d*. The legs of center 26*ea* have increasing spacing with increasing spacing from center 24 such that the junctures of the V-shape of center portion 26*ea* are located radially inward of portion 26*d* and of the inner edges of the remainder of strip 26. In the most preferred form, the juncture of the inner edge of center portion 26*ea* is located in the interior of bag 18 inward of the remaining portions of strip 26 and specifically extends inwardly from peripheries 20*a* and 22*a* in the range of 5 to 15 percent of the diameter of the round-like shape of walls 20 and 22. Second portion 26*e* further includes first and second connections 26*eb* extending accurately from the radially outer ends of the legs of center 26*ea* and generally parallel to but spaced from the inner edge of portion 26*d*.

In the most preferred form, portion 26*d* and the ends of connections 26*eb* opposite to center portion 26*ea* merge together into a united adhesive strip 26. It can be appreciated that walls 20 and 22 intermediate portions 26*d* and 26*e* are not adhered or otherwise connected together such that a chamber 82 is defined by portions 26*d* and 26*e* and seal portions 26*d* and 26*e*. In the most preferred form, pressure and/or heat sensitive adhesive is applied in a solid pattern around the entire periphery 20*a* and 22*a* of walls 20 and/or 22 but pressure and/or heat is only applied in the areas forming portions 26*d* and 26*e*. The juncture of portion 26*ea* is located radially inward of and outside of chamber 82. A slit 84 is cut and extends through only top wall 20 at a location corresponding to each chamber 82 and spaced inwardly from periphery 20*a* and at least partially inward from first portion 26*d*.

As bag 18 expands as a result of popping, puffing or expanding of the food product in the interior of bag 18 and specifically from water vapor and heated vapor pressure air, tensile forces or stresses are primarily placed upon adhesive strip 26 to separate walls 20 and 22. Due to the radially inward positioning of center portion 26*ea*, such force is initially placed on the juncture of the inner edge of the center portion 26*ea* before other portions of adhesive strip 26. As pressure inside of bag 18 increases, the force causes V-shaped center portion 26*ea* to fail at the juncture of the inner edge of center portion 26*ea* and moving radially outwardly down the first and second legs of center portion 26*ea* towards the juncture of the outer edge of center portion 26*ea*. Once the pressure in the interior of bag 18 reaches an inflated pressure level such that the failure reaches the juncture of the outer edge of center 26*ea*, chamber 82 is in communication through seal portion 26*e* with the interior of bag 18. Thus, vapor and air pressure are allowed to pass and are released from the interior of bag 18 to outside of bag 18 during the popping, puffing or expanding of the food product in the interior of bag 18, which in the preferred form is released into chamber 82 and then from chamber 82 is released through slit 84 and not directly from the interior of bag 18. Thus, portion 26*ea* prevents release of pressure into chamber 82 until the pressure inside of bag reaches the inflated pressure level resulting in the seal between wall portions 22*d* and 22*e* provided by portion 26*e* being removed.

Bag 18 according to the teachings of the present invention is advantageous in its ability to vent in a very predictable manner and location. In particular, a predictable location is important for safety reasons to insure that the hands and body of the consumer are kept away from hot pressure and other package contents during removal, holding and transport of bag 18. The predictable manner is important in maximizing the inflation and popping volume and in the safety and control of the escape of grease products from bag 18. Specifically, venting preferentially occurs at center 26*ea* because of its radially inward positioning and its shape. Center 26*ea* can then be located by the manufacturer at the most desired position according to the particular design of the package. In the preferred form of bag 18 shown, centers 26*ea* are located remote from where the consumer is intended to grip bag 18 and in particular remote from extensions 42 and 54 of the most preferred form. Additionally, venting predisposed to occur at centers 26*ea* insures that the pressure subjected to other portions of adhesive strip 26 and to seal 40 is not sufficient to cause failure and venting at other locations.

Further, it is desired to build pressure in the interior of bag 18 to fully expand bag 18 before venting pressure from the interior of bag 18 occurs and to keep sufficient pressure in the interior of bag 18 to keep it inflated into the double dome shape in the most preferred form. In particular, maximizing expansion of bag 18 has a positive impact on popping performance and especially in increasing pop volume and reducing un-popped kernels. In this regard, several factors play a role at what internal pressure in the interior of bag 18 will the interconnection by adhesive strip 26 at center portion 26*ea* fail. Particularly, the greater the angle between the legs of center 26*ea*, the greater the bond strength, with an angle in the range of 30 to 120 degrees being typical. Likewise, the wider the spacing at center 26*ea*, the greater the bond strength, with a width in the range of ⅛ to ½ inch (0.3 to 1.27 cm) being typical. Similarly, the greater amount of adhesive, the greater the bond strength, with adhesive applied at a rate of 2 to 8 pounds (0.75 to 3.0 kg) per ream being typical. Other factors which are important to the bond strength include the type of adhesive utilized, the temperature, pressure, and dwell time of the adhesive activation, and the like. Likewise, the size, shape, number, and location of slits 84 are also important in determining how much and how fast pressure is released, with slits 84 in the preferred form being U-shaped with the free ends of the U-shape extending generally radially outward.

The charge of kernels in the interior of bag 18 includes oil, fat, or similar grease product. It should be appreciated that such grease product will be liquefied and partially vaporized during cooking. Thus, such grease product can be carried out of the interior of bag 18 with the venting pressure through center 26*ea* after failure. It should be appreciated that such grease product is at an elevated temperature and, if in a sufficient amount, can burn or otherwise cause pain if contacted by the consumer. This is of particular concern with packages including a dome and/or arcuate shaped top as the grease product will tend to condense or otherwise collect on the inside surface of the top and will run downwardly under gravitational forces toward the bottom of the expanded package. If a vent area is located in the path to the bottom, such liquefied product will tend to be carried out with the escaping pressure. According to the preferred teachings of the present invention, the escaping pressure plus any entrapped grease product flows from the interior of bag 18 into chamber 82. It can be appreciated that chamber 82 should have a volume which is able to collect all of the grease product which is traveling out of the interior of bag 18 (typically in the range of 0 to 3 grams) and to minimize the amount of grease product which passes from chamber 82 through slit 84 (typically in the range of 0 to 1 gram). The parameters of the design of chamber 82 will be further explained hereinafter.

Providing slit 84 in top wall 22 and spaced radially inward from periphery 22*a* according to the preferred teachings of the present invention is particularly advantageous in providing safety and control in regard to the escape of the grease product from bag 18. It should be realized that the provision of chamber 82 should practically eliminate or minimize the escape of grease product through slit 84. Specifically, as previously indicated, the outer perimeter of bag 18 tends to crease about the inner edge of adhesive strip 26 creating a flange around the dome shape which can tend to fold upward or downward. In the event that the flange creases upward adjacent slit 84, a trough or crevice area is defined between the flange and the remaining portion of top wall 22 into which the grease product will be collected and controlled, so that any grease product which does escape from bag 18 does not find its way to bottom wall 20 of bag 18 where it can be contacted by the consumer. Additionally, in the event that a consumer should grip the flange adjacent slit 84 (rather than extensions 54) such as during the removal of bag 18 from the microwave, it is difficult for the consumer to get the end of a finger deep enough into the trough area to engage the grease product collected therein. On the other hand, should the flange crease downward adjacent slit 84, the grease product will run down top wall 22 to periphery 22*a* where it will drip therefrom typically onto the bottom of the microwave and specifically will not flow onto bottom wall 20 where it can be contacted by the consumer.

It should be appreciated that in addition to providing the necessary volume, it is desired that chamber 82 meet other parameters according to the preferred teachings of the present invention. In particular, chamber 82 should have a low profile radially from center 24 for several reasons. In this regard, connections 26*eb* extending generally parallel to portion 26*d* creates a chamber 82 of an elongated, arcuate shape extending generally adjacent to but generally outside of the inner edge of the remaining portions of adhesive strip 26. In this regard, it is desired that chamber 82 not change peripheries 20*a* and 22*a* to be much different than the round-like shape and in particular so as to convey that the portions adjacent chamber 82 are intended to be gripped by the consumer in a manner like extensions 54. Additionally, the presence of chamber 82 should not adversely affect the folding and creasing of the flange around the dome shape.

According to the preferred teachings of the present invention, after microwave cooking, bag 18 is removed from the microwave oven by gripping extensions 54, which are designed to provide a visual indication to the consumer of the intended area for gripping by the fingers in a manner described previously and hereinafter. In this regard, top wall 22 can include graphics which enhance this visual indication. The hand gripping either extensions 54 on one or both diametric sides of bag 18 for purposes of removing bag 18 from the microwave oven and/or transporting bag 18 to a different location, is then located remotely from slits 84 where venting of the interior of bag 18 has occurred. If the hand should grip the flange or rim spaced from extensions 54 such as, for an example, to rotate bag 18 in the microwave oven to align extensions 54 with the door opening for grasping, it is unlikely that the fingers will engage an amount of grease product outside of bag 18 which would cause bums or pain to the fingers.

After removal from the microwave oven, the consumer can grasp extension 42 between the consumer's thumb and one or more fingers of one hand and pull upwardly and diametrically, with extension 42 being free of adhesive securement resulting in advantages in its ability to be grasped. If necessary, bag 18 can be held by the consumer's other hand such as by grasping peripheral extensions 54 in the preferred form and/or the rim defined by adhesive strip 26 between walls 20 and 22 at the circumferential position corresponding to extension 42 if the preferred extensions 54 are not provided. In the most preferred form, portion 22*e* is completely removed from the remaining portions of bag 18. After removal of portion 22*e*, portion 22*d* acts like an annular rim in holding the remaining portions of bag 18 in a serving bowl function.

It should be appreciated that although the serving bowl function is accomplished by the multipaper fabrication provided by portions 22*d* and 22*e* in most preferred forms, the serving bowl function can be formed by other manners including by using perforations, tear strips, cut scoring, thinning sealant, and controlled delamination according to the teachings of the present invention.

Due to the nonlinear shape of seal 40, several difficulties could arise in maintaining consistent temperatures, pressures, and dwell times across the entire profile required in traditional heat seals. These requirements of traditional heat seals are eliminated by cold seal 40 which results in effectively sealing of wall portion 22*e* to wall portion 22*d* in a consistent manner around the entire peripheries 22*f* and 22*g*. Additionally, cold seal 40 of the wet seal adhesive type is well known to provide a bond at ambient temperatures to prevent leakage during transport, storage, and normal handling as well as during microwave cooking, the very reason they are utilized in the bottom seal of conventional rectangular bags. During expansion of bag 18, wall portions 22*d* and 22*e* crease and pucker to form the dome shape, with increased stress being placed on the interconnection in the creases and puckers. The expansion of bag 18 and other stresses placed upon portions 22*d* and 22*e* during popping are generally shear in nature, with bag 18 according to the teachings of the present invention utilizing a wet adhesive seal 40 easily maintaining interconnection without detrimentally venting for the cooking time. In this regard, seal 40 not detrimentally venting during cooking is advantageous in not allowing venting or the escape of grease product therethrough even if bag 18 is placed in the microwave oven in an inverted condition with wall 22 engaging the bottom of the oven, whether such placement is accidental or intentional.

Although highly desirable that wall portion 22*e* be very strongly secured before and during microwave cooking, it is also highly desirable that portion 22*e* be easily removable after cooking to allow access to the interior of bag 18 through inner periphery 22*f* and to provide the serving bowl function. Bag 18 according to the preferred teachings of the present invention is particularly advantageous in allowing access through a non-ventable seal 40 which is conventionally utilized for non-opening seals. Particularly, wall portion 22*e* is removed by peeling it upward, back upon itself, or at all angles in between, such that the force applied to seal 40 is in a 180° peel direction rather than 90° as in current rectangular bags where a separating force is applied to peel open the bag. The direction of force and the influence it has on the results and modes of failure of seals have long been recognized at least as shown by seal testing methods sanctioned by the TAPPI (Technical Association of Pulp and Paperboard Industry) which specifically controls the direction of force. Seal 40 of the cold type has been discovered to meet the requirements present in a nonlinear seal 40 required in a multiple layer top wall 22 of bag 18 according to the teachings of the present invention.

Specifically, bag 18 according to the preferred teachings of the present invention utilizes one or more of three opening mechanisms, with all three such opening mechanisms potentially being utilized for any given bag 18. Particularly, although seal 40 is generally subjected to shear stress as the result of popping, puffing or expanding of the food product in bag 18, when extension 42 and portion 22*e* are pulled away from portion 22*d*, primarily tensile or peel forces or stresses are placed upon the interconnection between portions 22*d* and 22*e*, and in particular, seal 40 is primarily subjected to tensile stress. The interconnection of portions 22*d* and 22*e* is removed by the tensile stress initially placed and concentrated on the juncture in the preferred form of a relatively sharp point of seal portion 40*aa* and then moved gradually down the legs away from the point of seal portion 40*aa* as the interconnection is removed. One of the opening mechanisms utilized in bag 18 according to the teachings of the present invention is failing and breaking the paper fibers forming portions 22*d* and 22*e* (and less likely breaking the adhesive between laminates 92 and 94 forming portions 22*d* and 22*e*) providing fiber tear of portions 20*d* and 20*e*. This opening mechanism is especially typically present and is typically the primary opening mechanism during the initial separation of portions 22*fa* and 22*ga*. Several factors can be manipulated to affect this opening mechanism including but not limited to the use of portions 22*d* and/or 22*e* formed of single or multiple laminates, the use of short or long paper fibers, of additives, and/or surface treatments and the particular laminating adhesive in the formation and the mass, thickness, rigidity, stiffness, and structural support of the material from which portions 20*d* and 20*e* are formed, which material could be different between portions 22*d* and 22*e*.

Another opening mechanism which could be utilized is the tearing of laminate 94 from laminate 92 in the peel element 90. It can again be appreciated that when removing portion 22*e* from portion 22*d*, stress placed on laminate 94 is mostly tensile rather than shear in a similar manner as placed on seal 40, such that failure of laminate 94 during removing portion 22*e* can more easily occur than by popping. This opening mechanism is typically present during separation of portions 22*fb* and 22*gb* and initial separation of portions 22*fc* and 22*gc*.

Another opening mechanism which would be utilized is the failure of seal 40 itself. Such failure is more likely to occur when seal 40 is at elevated temperatures and also during removal of portion 22*e* from portion 22*d* when seal 40 is subjected to tensile stresses rather than during popping when seal 40 is generally subjected to shear stresses. This opening mechanism is typically present during separation of portions 22*fc* and 22*fd* and from portions 22*fc* and 22*gd*. Several factors can be manipulated to affect this opening mechanism. Specifically, the width of seal 40 could be applied in the range of from infinitely thin to about ½ inch (1.27 cm) wide, with a width of 3/16 inch (0.48 cm) being utilized in a preferred form. Likewise, the adhesive forming seal 40 can be applied in different amounts such as in the range of between 2 to 8 pounds (0.75 to 3.0 kg ) per ream. Similarly, the manner of activation including compression forces, dwell time, and temperature (if required) can be varied to create differing bond strength of seal 40 between portions 22*d* and 22*e*.

According to the preferred teachings of the present invention, peel element 90 provides a synergistic result with the failure of seal 40 in opening bag 18. In particular, although laminate 94 does not tear or break away, laminate 94 including seal 40 thereon can be pulled away from laminate 92 as portion 22*e* is being pulled from portion 22*d*. This pulling away of laminate 94 and seal 40 creates a different peel angle right at the point of peel. This different peel angle concentrates the tensile forces more directly on seal 40 and makes an easier and more consistent peel of seal 40. Several factors can be manipulated to affect the distance that laminate 94 is pulled away from laminate 92 including the thickness of laminate 94 and the width of peel element 90.

It should be appreciated that the opening mechanisms of bag 18 according to the teachings of the present invention operate generally independent of temperature and at least are not detrimentally affected whether opened immediately after or delayed from the time of microwave cooking. In particular, many seals which are temperature activated and/or which allow venting during cooking will reattach if allowed to cool after cooking making opening therethrough difficult if opening through such seals is desired. Bag 18 can be easily opened immediately after cooking or even after several hours as the opening mechanisms of seal 40 operate effectively at either elevated or ambient temperatures and specifically with the bond of seal 40 not being significantly affected by temperature.

Although seal 40 is under mostly shear stresses during popping, adhesive strip 26 is under primarily tension stresses during popping. Thus, bag 18 according to the preferred teachings of the present invention increases the likelihood that venting will occur in adhesive strip 26 rather than seal 40, especially in the most preferred form utilizing the predictable, preferential venting provisions in adhesive strip 26 of the most preferred form.

Furthermore, it should be appreciated that the oval shape of wall portion 22*e* according to the preferred teachings of the present invention is particularly advantageous. Specifically, the area or size of the access opening can be maximized while the width of the access opening can be minimized. Because of its narrow width, portion 22*e* is located exclusively in central portion 34*a*, and fold lines 32*a* and 32*b* do not extend through wall portion 22*e* or seal 40. As fold lines 32*a* and 32*b* are hard or press folds, seal 40 is not subjected to the fold stress which would be encountered if fold lines 32*a* and 32*b* extended therethrough. Although extending through wall portion 22*e* and seal 40, fold lines 36 and 38, which are soft folds, do not detrimentally stress seal 40 as would hard folds. Additionally, due to the oval shape of wall portion 22*e*, the direction of force necessary to break the interconnection of seal 40 is generally along a straight line at a peeling angle that is more tangent to wall portion 22*d* of bag 18 so that there is less propensity for extension 42 and/or wall portion 22*e* to rip or tear. As set forth previously, seal portion 40*aa* concentrates tensile stresses to begin the seal failing process which gradually progresses down the legs to portions 40*ab* to portions 40*b*. Due to their parallel arrangement and as they are not spaced far apart, seal failure along portions 40*b* readily occurs without opening difficulties. After portions 40*b*, failure extends along portions 40*c* without difficulties as they extend towards the center of the pull direction. Complete removal of portion 26*e* would be best if the seal failure ended at an interconnection in the form of a sharp point, while opening the access opening while maintaining partial attachment of portion 26*e* remained with portion 26*d* would be best if the seal failure ended at an interconnection in the form of a perpendicular line. Portion 40*d* (together with portions 40*c*) provides an interconnection which extends relatively short in a direction perpendicular to the peel direction so that the consumer can decide whether to completely remove portion 26*e* or to leave it partially adhered. In this regard, the length of portion 26*e* in the peel direction can be minimized while the length of the access opening in that direction is maximized.

Furthermore, in the most preferred form shown, extension 42 extends radially from wall portion 22*e* in a direction parallel to the machine direction that the fibers within the paper forming wall portion 22*e* extend as the result of its manufacture, with the machine direction of the fibers being parallel to the major axis of the generally oval shaped periphery 22*g* of portion 22*e*. As paper will tend to tear in a direction parallel to the fiber direction, arranging extension 42 parallel to the fiber direction results in the pulling force on extension 42 and wall portion 22*e* to be a direction parallel to the fiber direction which tends to result in breaking the interconnection provided by seal 40 before tearing occurs in extension 42 and wall portion 22*e*. Further, wall portion 22*e* including extension 42 can be nested tightly on a web of paper compared to other shapes such as circular so there is less waste of the web of paper and less material is needed for fabrication.

Extensions 42 and 54 provide multiple functions according to the preferred teachings of the present invention. First, extensions 54 extend from the inflated bag 18 in a generally radial fashion, with both extensions 42 and 54 creating a visual indication where bag 18 should be opened as extensions 42 and 54 have the appearance as handle tabs. Second, extensions 42 and 54 provide increased area for grasping and gripping by the consumer. Also, as extensions 54 are located outwardly of the interior of bag 18, extensions 54 do not have the tendency to be hot to the touch as other portions of bag 18 which have direct contact with the popped popcorn. Thus, extensions 54 provide increased consumer safety from contacting hot surfaces. Similar consumer safety is also provided by extension 42.

Further, it should be appreciated that extensions 54 arranged according to the preferred teachings of the present invention is particularly advantageous. Specifically, with extensions 54 located on peripheries 20*a* and 22*a* and particularly circumferentially spaced from where venting occurs from bag 18 at the preferential venting locations, the hands of the consumer holding extensions 54 are not directly exposed to the vented steam from bag 18. Further, extensions 54 arranged diametrically opposite from each other provide optimal gripping by two hands for holding bag 18 with walls 20 and 22 in a generally horizontal position. In the fabrication of walls 20 and 22, extensions 54 are arranged in the trim out of a square cut in the web of paper, with the square cut being of the smallest size generally equal to the diameter of peripheries 20*a* and 22*a* to minimize waste and maximize material use. In this regard, 3 or 4 extensions 54 could be provided to allow the consumer multiple choices in grasping and removing bag 18 while in the microwave oven and while carrying or otherwise handling bag 18 after its removal from the microwave oven. Additionally, one pair of extensions 54 extending in the same radial direction as extension 42 of wall portion 22*e* and in line with the major axis of the oval shape of portion 22*e* and seal 40 is advantageous during removal of wall portion 22*e* as extension 42 located intermediate periphery 22*f* and the pair of extensions 54 when bag 18 is in an unopened condition can be pulled with one hand of the consumer while the other hand holds the pair of extensions 54 to keep the remaining portions of bag 18 from moving.

The presence of extensions 54 on peripheries 20*a* and 22*a* clearly has an influence on the creases and puckering of walls 20 and 22 during their expansion to the double dome shape and specifically walls 20 and 22 are constrained from creasing and puckering along the width of extensions 54. Particularly, there tends to be a hard crease or pucker at the edge of extensions 54 while adhesive strip 26 at the center of the extensions 54 is of a greater radial width and less likely to result in venting of steam therethrough. As the hand of the consumer holds extensions 54, it is desired that extensions 54 be as cool as possible and the consumer's hand grasping extensions 54 not be subjected to heat. Thus, venting of steam at extensions 54 is undesirable as the consumer's hand could come in contact with or in close proximity to the vented steam.

Likewise, providing extensions 54 on both walls 20 and 22 provides added extension strength for holding bag 18 than if bag 18 were held by a simple thickness of paper. Since extensions 54 of walls 20 and 22 are interconnected, they tend to be less flexible and more rigid. Thus, extensions 54 are less likely to flip up or down during expansion of bag 18 and/or in the event they should engage the sides of the microwave oven cavity.

Now that the basic teachings of the present invention have been explained, many extensions and variations will be obvious to one having ordinary skill in the art. For example, although bag 18 of the most preferred form includes the combination of several, unique features believed to obtain synergistic results, packages for use in microwave ovens could be constructed according to the teachings of the present invention including such features singly or in other combinations. In this regard, such features can be utilized singly or in other combinations in different types of microwaveable packages and/or for other types of food products which are desired to be subjected to microwave energy in a microwave oven than that of the preferred embodiment of the present invention. As an example, although believed to produce synergistic results, features of the present invention can be utilized in bags 18 of different configurations and specifically are not limited to utilization in bags 18 formed from walls 20 and 22 of round-like shapes and/or expanding to a double dome shape.

Similarly, although believed to produce synergistic results, features of the present invention can be utilized in bags 18 having other opening techniques than an access opening closed by a closure panel.

Additionally, although the particular manner of manufacture, filling, and folding of bag 18 is believed to be advantageous including but limited to having a final conventional, rectangular shape for secondary packaging purposes, bag 18 can be manufactured, filled and/or folded in other manners according to the teachings of the present invention. However, it may be desirable to fold or otherwise configure bag 18 to have a final shape which is different than other conventional shapes to emphasize the uniqueness of bag 18 in the marketing thereof. In this regard, extensions 54, which are exposed in the final shape, could extend linearly from the wing 38*a* whereas extensions 54 (and part of adhesive strip 26) and be folded over relative to wing 36*a* to reduce the oval size of the final shape.

Likewise, packages for use in microwave ovens can be fabricated and filled in other manners according to the teachings of the present invention. As an example, the ability of seal 40 to be interconnected with the application of pressure in the absence of heat enhances the ability to seal wall portion 22*e* in line with filling bag 18. Thus, adhesive strip 26 could be interconnected around the entire peripheries 20*a* and 22*a* and bag 18 filled through the access opening defined by periphery 22*f* of wall portion 22*d* and wall portion 22*e* positioned over wall portion 22*d* and seal 40 interconnected without the melting, leaking and/or wicking that could occur if seal 40 was of the hot seal type.

Thus since the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

What is claimed is:

1. Expandable microwave package for holding a food product for popping, puffing or expanding in a microwave oven comprising, in combination: a bag having an interior for holding a charge of food product to be subjected to microwave energy and having a wall including an access opening, with the bag further including a closure portion having an outer periphery of a size greater than the access opening, with the bag including a seal between the closure portion and the wall around the access opening, with the bag expanding into an expanded condition, with the seal being formed from wet seal adhesive which does not vent as the result of or during the popping, puffing or expanding of the food product in the interior of the bag, with the seal being formed by a plurality of spaced, generally parallel bands defining a plurality of spaced, parallel spaces therebetween for resisting any leakage from the interior of the bag through the seal, with one of the wall and the closure portion including a peel element allowing the closure portion to peel from the wall without requiring the failure of the seal, with the seal overlaying the peel element, with the bag further including a chamber including a first, V-shaped, seal portion having first and second legs interconnected at first ends at a juncture with the first and second legs extending at a non-parallel angle relative to each other from the juncture, wherein the juncture is located in the interior of the bag inward of the remaining portions of the seal portion, with the first, V-shaped seal portion being primarily subjected to tensile stress by the expansion of the bag as the result of popping, pulling or expanding of the food product in the interior of the bag resulting in release of pressure from the interior of the bag during the popping, puffing or expanding of the food product in the interior of the bag, with the bag further including a vent opening from the chamber to the outside of the interior of the bag, wherein pressure is released from the interior of the package through the chamber and through the vent opening, with the seal including a second, V-shaped, seal portion having first and second legs interconnected at first ends at a juncture with the first and second legs extending at a non-parallel angle relative to each other from the juncture.

2. Expandable, substantially circular microwave package for holding a food product for popping, puffing or expanding in a microwave oven comprising, in combination: a bag having an interior for holding a charge of food product to be subjected to microwave energy and having a wall including an access opening, with the package further having a chamber in communication with the interior, and a vent opening from the chamber to outside of the interior of the bag, wherein measure is released from the interior of the package through the chamber and through the vent opening, with the bag further including a closure portion having an outer periphery of a size greater than the access opening, with the bag including a seal between the closure portion and the wall around the access opening, with the bag expanding into an expanded condition, with the seal applied as a plurality of spaced, parallel, adjacent bands, with the bands defining a plurality of spaced, parallel spaces therebetween creating a tortuous path for resisting any leakage from the interior of the bag through the seal which does not vent as the result of or during the popping, puffing or expanding of the food product in the interior of the bag.

3. The expandable microwave package of claim 2 wherein the seal is generally oval in shape and has a major axis and a minor axis, with the seal including a first, generally semicircular, portion of a diameter generally equal to the minor axis of the generally oval shape, with the seal including second and third portions extending from the first portion and generally parallel to the major axis, with the seal further including a fourth portion extending from and interconnecting the second and third portions.

4. The expandable microwave package of claim 3 wherein the fourth portion includes an arcuate portion.

5. The expandable microwave package of claim 4 wherein the fourth portion includes fifth and sixth portions extending from the second and third portions at an obtuse angle toward each other, with the fifth and sixth portions extending tangentially from the arcuate portion, with the arcuate portion having a diameter substantially less than the diameter of the first portion.

6. The expandable microwave package of claim 3 wherein the fourth portion includes fifth and sixth portions extending from the second and third portions at an obtuse angle toward each other.

7. The expandable microwave package of claim 3 wherein the first portion includes a V-shaped portion for each of the bands having first and second legs interconnected at first ends at a juncture with the first and second legs extending at a nonparallel angle from the juncture, with a bisector of the nonparallel angle of the first and second legs extending in line with the major axis of the generally oval shape and the juncture located on the bisector.

8. Expandable, substantially circular microwave package for holding a food product for popping, puffing or expanding in a microwave oven comprising, in combination: a bag having an interior for holding a charge of food product to be subjected to microwave energy and having a wall including an access opening, with the bag further including a closure portion having an outer periphery of a size greater than the access opening, with the bag including a seal between the closure portion and the wall around the access opening, wit the bag expanding into an expanded condition, wit the seal being formed by a plurality of spaced, parallel bands defining a plurality of spaced, parallel spaces therebetween creating a tortuous path for resisting any leakage from the interior of the bag through the seal with the package further having a chamber in communication with the interior, and a vent opening from the chamber to outside of the interior of the bag, wherein pressure is released from the interior of the package through the chamber and through the vent opening.

9. The expandable microwave package of claim 8 wherein the seal includes a V-shaped portion having first and second legs interconnected at first ends at a juncture with the first and second legs extending at a nonparallel angle relative to each other from the juncture, with a bisector of the nonparallel angle of the first and second legs extending in line wit the major axis of the generally oval shape and the juncture located on the bisector.

10. The expandable microwave package of claim 9 with the seal being fanned of wet seal adhesive.

11. The expandable microwave package of claim 10 with the seal being generally oval in shape and having a major axis and a minor axis, with the seal including a first, generally semicircular, portion of a diameter generally equal to the minor axis of the generally oval shape, with the seal including second and third portions extending from the first portion and generally parallel to the major axis, with the seal further including a fourth portion extending from and interconnecting the second and third portions, with the first portion including the V-shaped portion.

12. The expandable microwave package of claim 11 wherein the access opening and the outer periphery of tho closure portion are generally oval in shape.

13. The expandable microwave package of claim 12 further comprising, in combination: an extension formed on the outer periphery of the closure portion outward of the seal.

14. The expandable microwave package of claim 13 wherein the extension extends in line with the major axis of die generally oval shape.

15. A substantially circular container for holding a popcorn to be subjected to microwave energy in a microwave oven comprising, in combination: a package having an interior for holding a charge of popcorn to be subjected to microwave energy; with the package further baying a chamber in communication with the interior; and a vent opening near a periphery of the package, from the chamber to the outside of the interior of the bag, a seal formed from parallel bands creating a tortuous oath to prevent leaking, wherein pressure is released from the interior of the package through the chamber and through the vent opening, with the package farther having an oval seal.

16. The container of claim 15 wherein the package comprises a bag including a first wall and a second wall, with the first and second walls each formed of a sheet of flexible material, with the first and second walls being interconnected at a seal, with the seal being divided at a vent location into a first seal portion and a second seal portion, with the chamber being defined by the first and second walls and the first and second seal portions, with the second seal portion located inwardly of the first seal portion, with communication of the chamber with the interior being through the second scat portion.

17. The container of claim 16 wherein the vent opening is formed in the first wall and located inwardly of the first seal portion.

18. The container of claim 17 wherein the vent opening is in the form of a slit cut in the first wall.

19. The container of claim 18 further comprising, in combination: means for preventing release of pressure until the pressure in the interior of the package reaches an inflated pressure level.

20. The container of claim 19 wherein the pressure release preventing means comprises a seal for the communication of the chamber with the interior, with the seal being removed at the inflated pressure level.

21. The container of claim 20 wherein the seal includes a V-shaped seal portion having first and second legs interconnected at first ends at a juncture with the first and second legs extending at a non-parallel angle from the juncture, with the juncture located in the interior of the package, with the V-shaped seal portion being primarily subjected to tensile stress when the charge of food product popcorn is subjected to microwave energy.

22. Expandable microwave package for holding a food product for popping, puffing, or expanding in a microwave oven comprising, in combination: a bag having an interior for holding a charge of food product to be subjected to microwave energy and including a first wall and a second wall, with the first and second walls each formed of a sheet of flexible material, with the first and second walls being interconnected at a seal, with the seal including a first, V-shaped, seal portion having first and second legs interconnected at first ends at a juncture with the first and second legs extending at a non-parallel angle relative to each other from the juncture, with the seal being subjected to tensile stress, with the seal applied as a plurality of spaced, adjacent, parallel bands, with die bands defining a plurality of spaced, parallel spaces therebetween creating a tortuous path for resisting any leakage from the interior of the bag through the seal with the interconnection of the first and second walls being removed by the tensile stress initially placed on the juncture and then moved down the legs away from the juncture of the first, V-shaped, seal portion.

23. The expandable microwave package of claim 22 wherein the juncture is has a slit located in the interior of the bag inward of the remaining portions of the seal, with the tensile stress being subjected to the seal by the expansion of the bag as the result of popping, puffing or expanding of the food product in the interior of the bag, with the removal of the interconnection and opening of the slit allowing release of pressure from the interior of the bag during the popping, puffing or expanding of the food product in the interior of the bag.

24. The expandable microwave package of claim 23 wherein the seal includes a second seal portion, with a chamber being defined by the first and second walls and the first and second seal portions, with the juncture located outside of the chamber, with the removal of the interconnection allowing release of pressure from the interior of the bag into the chamber.

25. The expandable microwave package of claim 24 further comprising, in combination: a vent opening from the chamber to outside of the interior of the bag, with the vent opening allowing release of pressure from the chamber to outside of the interior of the bag and not directly from the interior of the bag.

26. The expandable microwave package of claim 25 wherein the vent opening is formed by a slit in the first wall near a periphery of the package.

27. The expandable microwave package of claim 26 wherein the first and second walls each include an outer periphery portion, with the outer periphery portions of the first and second walls being interconnected at the seal and puckering as the bag expands, with the first wall forming the top when the charge of food product in the interior of the bag is subjected to microwave energy, with the vent opening being spaced from the outer periphery portion of the first wall.

28. The expandable microwave package of claim 27 wherein the seal is formed from adhesive which is activated by the application of heat and/or pressure.

29. The expandable microwave package of claim 23 with at least one of the first and second walls including at least a first extension extending outwardly from the interior of the bag, with the first, V-shaped, seal portion located as circumferentially remote from the fast extension as possible.

30. The expandable microwave package of claim 29 with a second extension being included diametrically opposite the first extension, with the first, V-shaped, seal portion being located 90° between the first and second extensions.

31. The expandable microwave package of claim 22 wherein the seal is primarily subjected to shear stress as the result of popping, puffing or expanding of the food product in the bag, with the first wall including an access opening, with the seal located around the access opening such that the second wall closes the access opening.

32. The expandable microwave package of claim 31 wherein the second wall includes an extension extending along a bisector of the non-parallel angle of the first and second logs and in a direction opposite to the direction that the first and second legs extend from the juncture.

33. The expandable microwave package of claim 32 wherein the seal is annular in configuration.

34. The expandable microwave package of claim 33 wherein the seal is formed from wet seal adhesive, which does not vent when the charge of food product held in the interior of the bag is subjected to microwave energy.

* * * * *